US006810991B1

(12) United States Patent
Suzuki

(10) Patent No.: US 6,810,991 B1
(45) Date of Patent: Nov. 2, 2004

(54) ENFOLDING SOUND BARRIER

(76) Inventor: Masao Suzuki, 5-13, 2-chome Kajino-cho, Koganei-shi, Tokyo 184-0002 (JP)

( * ) Notice: Subject to any disclaimer, the term of this patent is extended or adjusted under 35 U.S.C. 154(b) by 4 days.

(21) Appl. No.: 10/381,656

(22) PCT Filed: Nov. 8, 2000

(86) PCT No.: PCT/JP00/07839

§ 371 (c)(1),
(2), (4) Date: Mar. 28, 2003

(87) PCT Pub. No.: WO02/38869

PCT Pub. Date: May 16, 2002

(51) Int. Cl.[7] ..... B64F 1/26; G10K 11/16; E04B 1/84; E04B 1/82

(52) U.S. Cl. ..... 181/210; 181/285; 52/144

(58) Field of Search ..... 181/210, 285, 181/287, 295; 52/144, 145, 238.1, 241

(56) References Cited

U.S. PATENT DOCUMENTS 4,750,586 A * 6/1988 Lerner et al. ..... 181/295
5,641,950 A * 6/1997 Kotter ..... 181/285
5,678,364 A * 10/1997 Shima et al. ..... 181/210
5,739,482 A * 4/1998 Shima et al. ..... 181/210
6,006,858 A * 12/1999 Shima et al. ..... 181/210
6,019,189 A * 2/2000 Shima et al. ..... 181/210

FOREIGN PATENT DOCUMENTS

JP 09177004 A * 7/1997 ..... E01B/19/00
JP 09228323 A * 9/1997 ..... E01F/8/00
JP 09279521 A * 10/1997 ..... E01F/8/00
JP 10025714 A * 1/1998 ..... E01F/8/00
JP 11-350435 12/1999
WO 93/12298 6/1993

* cited by examiner

*Primary Examiner*—Shih-Yung Hsieh
*Assistant Examiner*—Edgardo San Martin
(74) *Attorney, Agent, or Firm*—Wenderoth, Lind & Ponack L.L.P.

(57) ABSTRACT

An enfolding sound barrier manifests a high effect of abating noise as compared with the conventional sound barrier and is capable of enhancing durability and field workability and securing a view of the environment satisfactorily. The enfolding sound barrier has a sidewall 13 or a different sidewall capable of being seen through and an enfolding body 1 which is constructed in an enfolding shape. The enfolding body 1 includes a bent member 2 furnished with a plurality of bent parts 2*a* and which is attached to the sidewall 13 for application to an express highway or railroad, or attached to the different sidewall for application to an ordinary road.

17 Claims, 5 Drawing Sheets

ENFOLDING SOUND BARRIER

TECHNICAL FIELD

This invention relates to an enfolding sound barrier for abating the noise from vehicles traveling on roads including express highways or from electric cars traveling on railroads or from other sound sources, and particularly relates to the construction of an enfolding sound barrier which utilizes principles, such as multiple diffraction, interference of sound waves and containment of reflected sound in the main track.

BACKGROUND ART

It is universally known that transport facilities are important socially and economically and abundant with features, such as public welfare and usefulness. In consequence of the rapid advance of such transport facilities, however, the noise emanating from electric cars and vehicles has been posing a serious social problem. Particularly, the seriousness of the problem of noise in the urban residential district has been growing in depth, and the problem of preventing noise pollution has been creating a profound public interest.

As measures for the prevention of the noise, it is conceivable to abate the noise from various transport facilities that are sources of noise or separate sources of noise, such as railroads and roads that are utilized by the transport facilities, from the residential district. These measures are invariably out of the ordinary. As a measure for realizing comparatively easy prevention of the noise, the practice of blocking the noise from the sound source by setting up a barrier, such as a soundproofing implement, has been in vogue. Thus, various soundproofing devices have been proposed.

For the purpose of reducing the noise emanating from electric cars and vehicles in motion traveling along transportation routes, for example, the sidewalls bordering on an express highway or a railroad are each provided on the upper part thereof with a device possessing a soundproofing property so that this device may be relied on to abate the sound. For the sake of increasing the soundproofing effect in this case, such means as forming the device wholly in a large size, enlarging the area of sound-absorbing material applied fast to the device, or imparting a complicated shape to the device are generally adopted to effect the absorption of the noise generated at the relevant site of noise abatement.

The railroad or the road which is provided with the soundproofing device necessitates a decrease in the height of the soundproofing device for the purpose of enabling the super-express train, elevated railroad train or vehicle to command the scene or the view of the surrounding district or reducing to the fullest possible extent the influence of the wind pressure exerted thereon. With a view to fulfilling this necessity, various means have been disclosed, such as a means of fixing sound-absorbing material along the upper edge of a given sidewall to thereby induce absorption of the sound waves tending to diffract to the reverse side of the sidewall, and a means of projecting a horizontal edge wall from the upper end of the sidewall toward the road, projecting from the leading terminal of this edge wall an upward directed wall rising vertically and an extended wall directed upward aslant toward the side opposite the railroad and further providing the projected walls each with a sound-absorbing material to thereby produce a soundproofing unit capable of absorbing the sound waves separated downward from the noise generated by the diffracting sound waves or the pantograph. These devices are generally formed of plates of steel with a view to enhancing the strength thereof.

The noise, however, advances around the edge of a wall even so much as to reach the rear of the wall due to the diffraction of sound as mentioned above. When the soundproofing device is installed so as to avoid rising above the windows of electric cars and other vehicles, therefore, the noise readily advances around the edge of the sidewall and reaches the rear thereof. Consequently, the soundproofing device possibly fails to afford sufficient prevention of the noise.

When the soundproofing device is installed at a high position for the purpose of enhancing the soundproofing effect, it may impair the view in proportion to the size of the device, and may possibly prevent the surrounding sights from being clearly viewed by passengers in an electric car or a vehicle.

The enlargement of the whole device entails such problems as requiring increased strength complicating the structure thereof, causing the weight thereof to increase so much as to render the handling thereof difficult, and increasing the cost of materials possibly at a sacrifice of economy.

This invention has been developed as a consequence of repeated efforts in trial and error and improvement concerning soundproofing devices with a view to overcoming the conventional problems. The object of this invention consists in providing an enfolding sound barrier which is highly effective in abating noise as compared with the conventional soundproofing devices, and further providing an inexpensive enfolding sound barrier which is improved in durability and field working and which can secure a generous view of a surrounding sight.

SUMMARY OF THE INVENTION

The present invention provides an enfolding sound barrier comprising a sidewall or a transparent sidewall capable of being seen through, an enfolding body constructed in an enfolding shape with a bent member furnished with a plurality of bent parts and attached to the sidewall for application to an express highway or a railroad, or attached to the different sidewall for application to an ordinary road.

In the enfolding sound barrier, the enfolding body is provided in an upper part of a back surface side thereof with a sound-absorbing part disposed in an inclined state. The bent member is provided with a sound-absorbing material fixed onto an outer peripheral surface side of a leading terminal region of the bent member.

In the enfolding sound barrier, the plurality of bent parts of the bent member comprises four bent parts preferably having respective angles of 142, 142, 142 and 142 degrees. The barrier can further comprise a supporting member to which the bent member is integrally fixed to form a further enfolding shape and which is furnished with a bent part having an angle of 173 degrees.

The enfolding sound barrier can further comprise at least one bent member identical with the bent member, and the bent members are piled in two or more stages, one on top of the other, or one on top of another. On the other hand, the enfolding sound barrier can further comprise a leading terminal member, and the bent member, the supporting member and the leading terminal member are each made of an aluminum alloy and formed in a plate shape by a working means including extrusion molding.

In the enfolding sound barrier, the enfolding member has an enfolding region desirably attached so as to be displaced in a direction of increasing a width of an express highway or railroad relative to the sidewall. The different sidewall alternatively may be formed of a resinous material of polycarbonate plastic for application to an ordinary road.

DETAILED DESCRIPTION OF THE INVENTION

Figure 1:
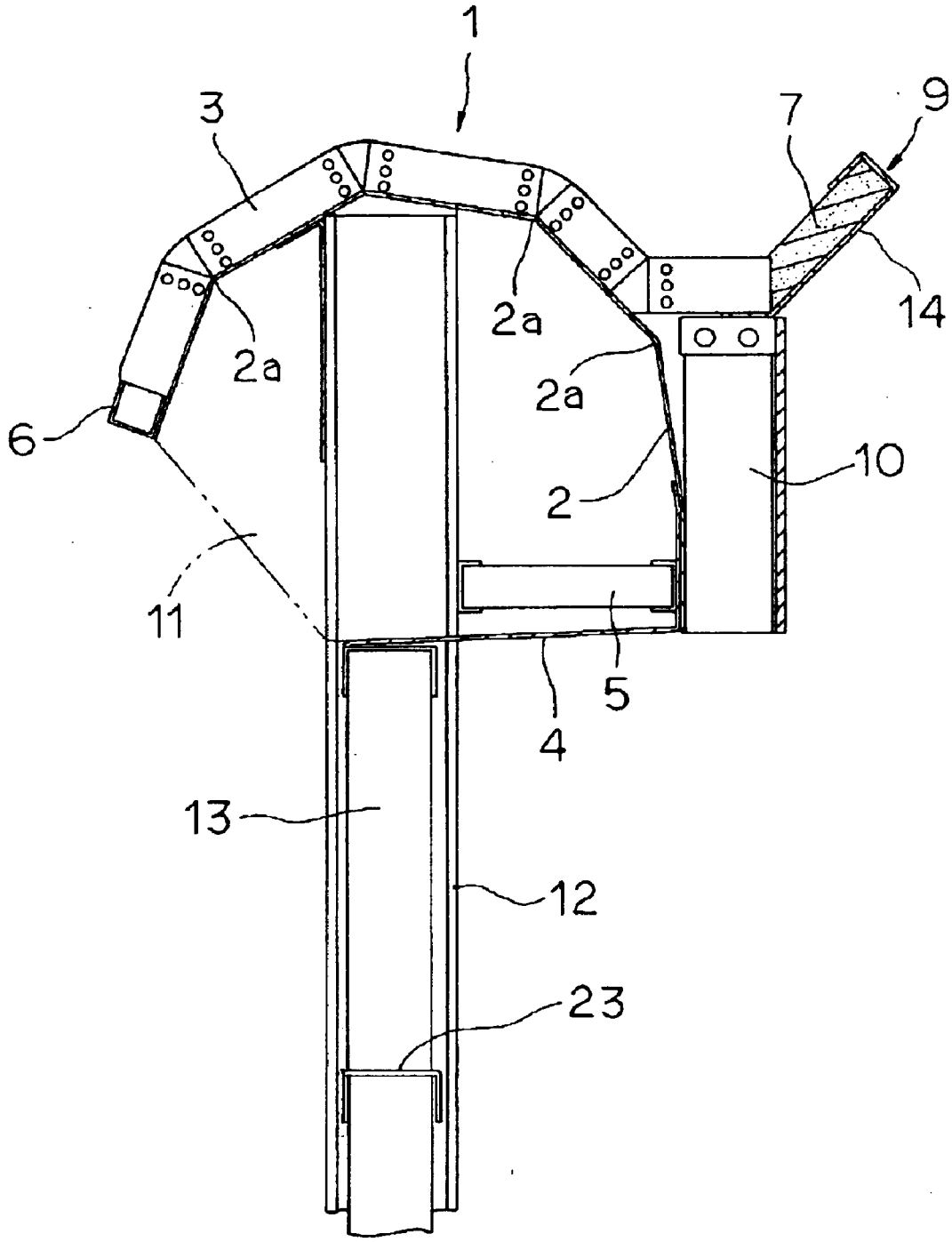
FIG. 1 is a longitudinal section illustrating one example of the enfolding sound barrier contemplated by this invention.
Figure 2:
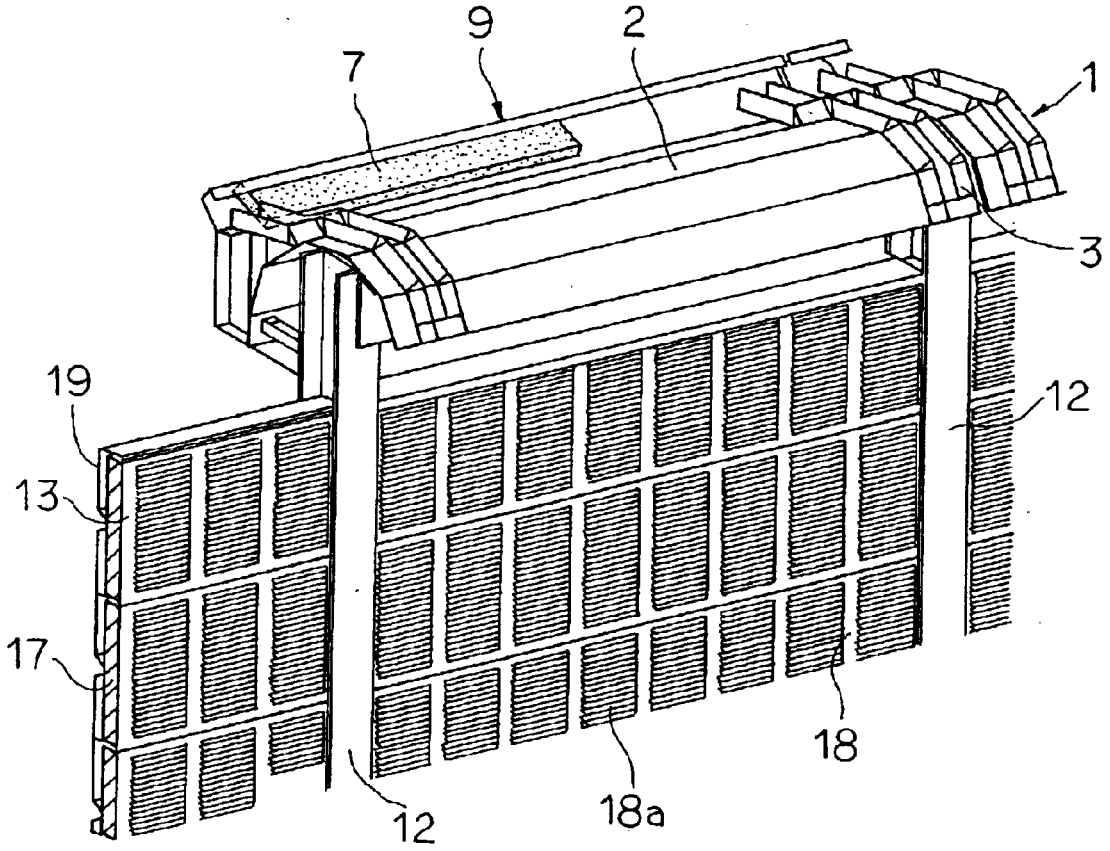
FIG. 2 is a perspective view illustrating the construction of the sound barrier.

Now, working examples of the enfolding sound barrier according to this invention will be described in detail below with reference to the accompanying drawings. With reference to FIG. 1 and FIG. 2, reference numeral 1 denotes an enfolding body assuming an enfolding shape. This enfolding body 1 is made to form the enfolding shape with a bent member 2 having a plurality of bent parts 2*a*. This enfolding body 1 is set up on a sidewall 13 to be fixed to H-section steel members 12 which are erected at proper intervals along either or both of the sides of an express highway or a railroad.

Further, this enfolding body 1 is such that a multiplicity of its replicas are installed as concatenated end to end in the direction of length of each of the sound barriers running parallel to a railroad. The sidewall 13 is composed of a soundproofing panel 18 of sheet metal having a multiplicity of holes 18*a* bored therethrough as by a punching work, a sound-absorbing material 17 formed of glass wool, latex, glass fibers or felt in a thickness of about 95 mm, and a background 19 serving to cover the back side of the sidewall 13. The soundproofing panel 18, the sound-absorbing member 17 and the background (base) 19 are piled up (layered) sequentially in the order mentioned from the rail side onward to form a wall region. Further, the opposite ends of this wall region are inserted into the depressed regions of the adjacent steel members 12 so as to be nipped therein.

The wall region has an elongated shape in the horizontal direction. During the attachment of such wall regions to the steel member 12, the upper surface of each wall region is reinforced with a reinforcing member 23 having a cross section substantially of the shape of three sides of a square before another wall region is superposed thereon. The sidewall 13 is constructed so as to allow partial protrusion of the upper end sides of the steel members 12.

The enfolding body 1 has an enfolding region mounted on the projected upper surface regions of the steel members 12, the enfolding region being composed of the bent member 2 formed by bending a thin steel sheet (3 mm in thickness in the present example), a supporting member 4 formed at the terminal part of the bent member 2, a retaining member 3 formed along the outer peripheral surface of the bent member 2, and a leading terminal member 6 having a cross section substantially of the shape of three sides of a square and fixed to the leading terminal side of the bent member 2. The bent member 2, supporting member 4 and leading terminal member 6 are each made of an aluminum alloy as raw material, and are obtained by forming sheets of the raw material in relevant shapes by a working means, such as extrusion molding, and folding these sheets as by press working. Particularly, during the extrusion molding directed toward the formation of the bent member 2, the product can be formed in a proper size in the direction of length. In the present example, the bent member 2 has a size of about 2000 mm in the direction of length.

During the course of press working, four bent parts 2*a* in the bent member 2 are formed at angles respectively of about 142°, about 142°, about 142°, and about 142°, and a bent part 4*a* in the supporting member 4 is formed at an angle of about 173. The supporting member 4 is fixed integrally at the terminal region of the bent member 2 as to form an enfolding shape. A bent part 4*b* is formed on the other terminal side of the supporting member 4. This bent part 4*b* is fixed onto the sidewall 13 so as to be engaged with the upper surface of the sidewall 13. During the installation of the enfolding region, by setting up the enfolding region on the sidewall 13 while keeping the bent part 4*b* in engagement with the sidewall 13, the enfolding region is able to contact the upper surface region of the steel member 12 in the neighborhood of the top part of the inner peripheral surface of the bent member 2. By causing the substantially central portion of the enfolding region to be supported by the steel member 12, the enfolding region can be displaced relative to the sidewall 13 in the direction of width of an express highway or railroad and set up without causing the enfolding region to thrust out even slightly into the road or the railroad.

Numeral 5 denotes a reinforcing member that is adapted to reinforce the enfolding region by being nipped (held) between the steel member 12 and the supporting member 4.

Figure 3:
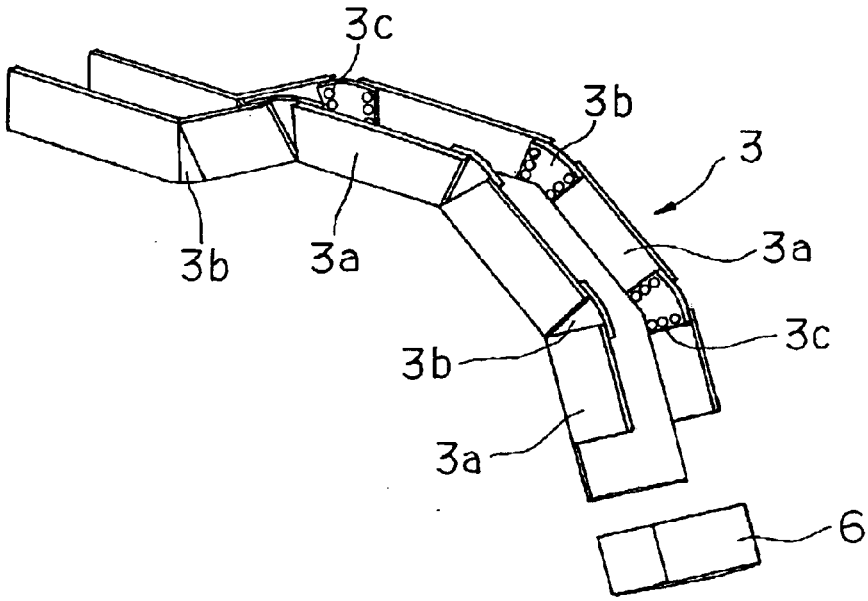
FIG. 3 is a perspective view of a retaining member.
Figure 4:
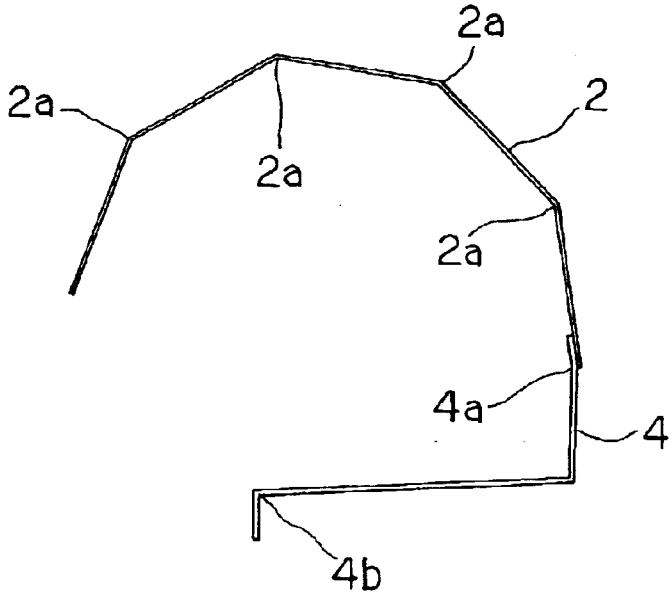
FIG. 4 is a side view of a bent member.

The retaining member 3 is obtained by integrally fixing joining members 3*b* formed of sheet metal substantially in the shape of a fan to channels 3*a* formed of sheet metal in a cross section substantially in the shape of three sides of a square in a suitable length and in varying shapes with bolts 3*c*, as shown in FIG. 3. Further, in the particular channel 3*a* that falls on the leading terminal side, the leading terminal member 6 is fixed to the extended portion formed by extending this channel.

Multiple retaining members 3 are fitted along the outer peripheral shape of the bent member 2 at proper intervals in the direction of length.

An angular pipe 10 is attached to the back surface side of the enfolding region. The supporting member 4 and retaining member 3 are fixed to this angular pipe 10. Since the bent member 2 and retaining member 3 are reinforced with this angular pipe 10, the sound barrier when installed in an express highway or railroad can be formed so strongly as to withstand the strong wind, such as a gust which is generated by a traveling vehicle or a side wind. The component denoted by numeral 11 and indicated with an alternate long and short line is a side cover. When such side covers 11 are attached one each to the opposite lateral edges of the enfolding body 1, they can reinforce the enfolding body further and prevent it from being shaken.

Denoted by numeral 9 denotes a sound-absorbing part. This sound-absorbing part 9 includes a fixture 14 formed of steel sheet with a thickness of about 50 mm, and a sound-absorbing material 7 resembling the sound-absorbing material 17 of the sidewall 13 formed of glass wool, latex, glass fibers or felt as raw material placed in fixture 14. When the sound-absorbing materials 7 and 17 are formed of the material made by Bridgestone Tire Co., Ltd. and sold under the trademark designation of "FIBRITE," for example, instead of the raw materials cited above, they can manifest a good sound-absorbing effect.

The surface region of the sound-absorbing material 7 is preferred to undergo a waterproofing treatment or a treatment to apply a water repellent finish. Further, the sound-absorbing material 7 may be coated with a reticular member not shown in the diagram for the sake of protecting the surface thereof.

The sound-absorbing part 9 is inclined with respect to a horizontal plane at the upper end on the back surface side of the enfolding body 1. This sound-absorbing part 9 is fixed so that it is inclined by an angle of about 45°. When a noise occurs, therefore, it is efficiently abated because the sound causing this noise is bent around the bent member 2, advanced along the outer periphery of the enfolding region and absorbed by the sound-absorbing material 7. Optionally, another sound-absorbing material, though not shown in the diagram, may be fixed onto the outer peripheral surface side of the leading region of the bent member 2.

Though the present example is described as being provided with the bent member in one stage, such bent members 2 may be piled in two stages, one on top of the other, or in more stages, one on top of another.

Now, another example of this invention will be described below.

Figure 5:
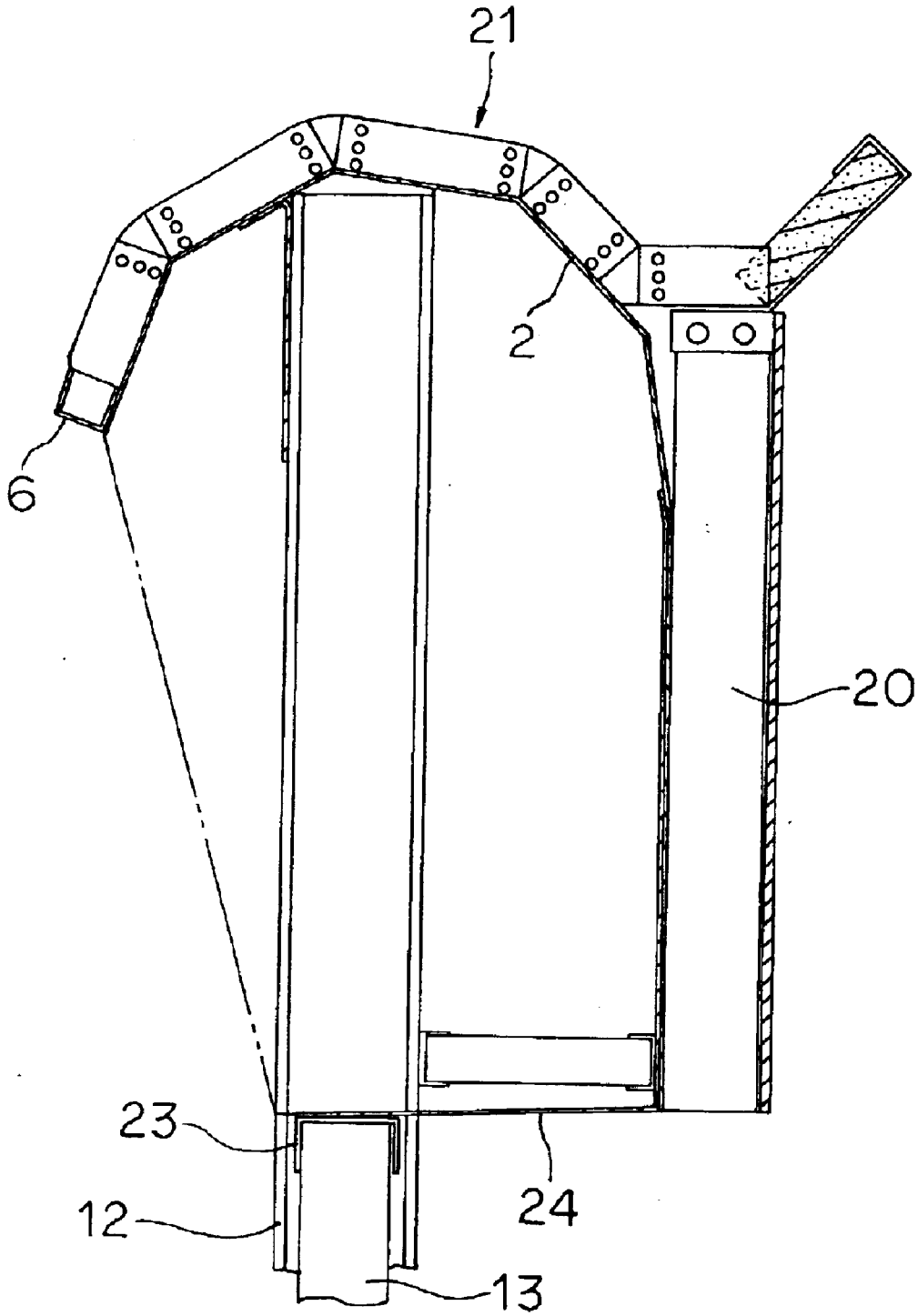
FIG. 5 is a longitudinal section illustrating another example of the enfolding sound barrier contemplated by this invention.

FIG. 5 is a longitudinal section illustrating another example of the enfolding sound barrier contemplated by this invention. In this example, a supporting member 24 and an angular pipe 20 each extend in a vertical direction so as to enlarge the enfolding region of an enfolding body 21.

By properly enlarging the height of the enfolding region as described above proportionately to the height of the sidewall 13, for example, it is possible to increase the soundproofing effect to be manifested by increasing the quantity of noise to be enfolded.

Figure 6:
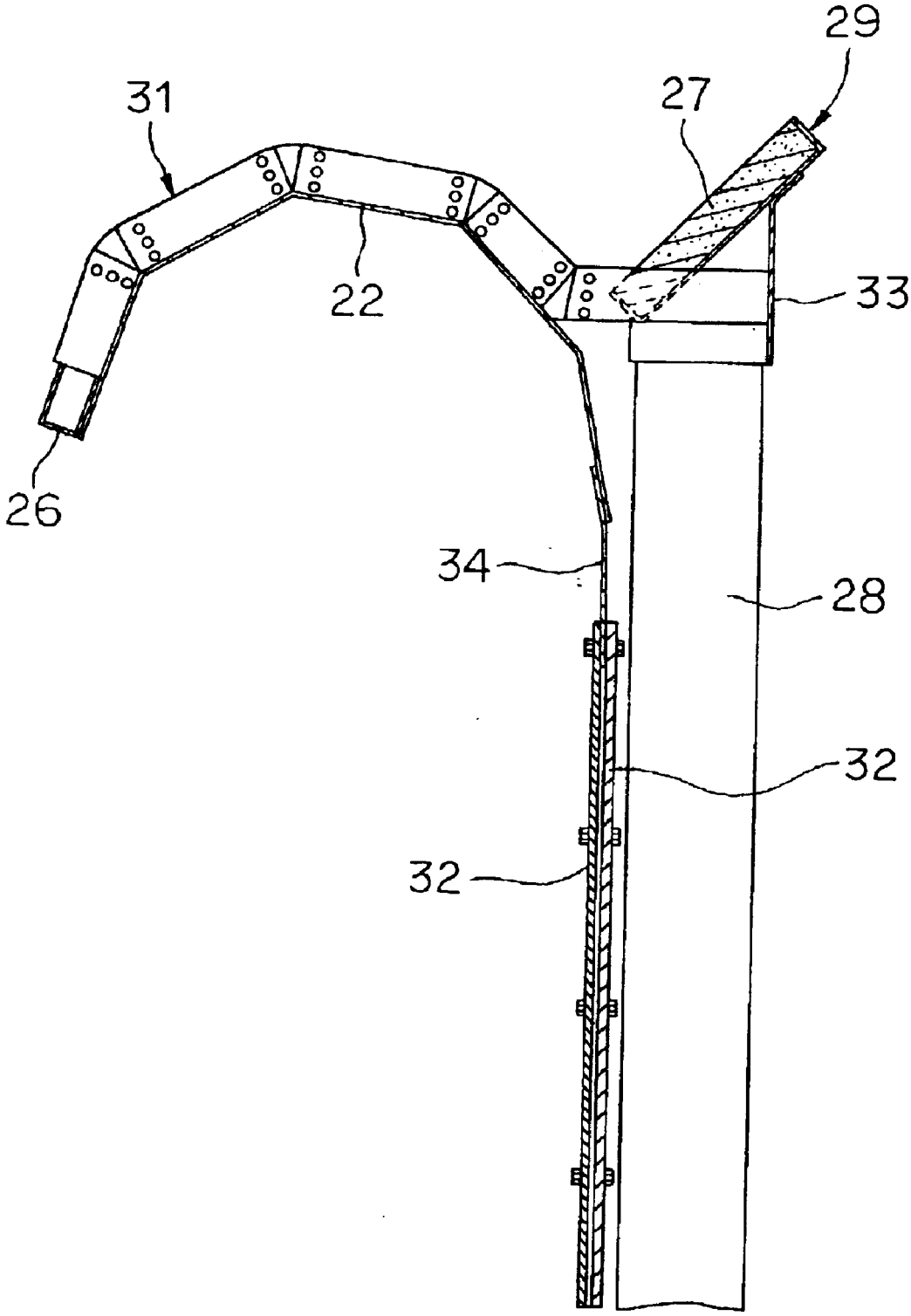
FIG. 6 is a longitudinal section illustrating yet another example of the enfolding sound barrier contemplated by this invention.

FIG. 6 is a longitudinal section illustrating yet another example of the enfolding sound barrier contemplated by this invention. An enfolding body 31 in this example is attached to a transparent sidewall that is capable of being seen through and is intended to be used for an ordinary road.

Reference numeral 28 denotes a supporting column. This supporting column 28 is erected in an excavation formed preparatorily by digging in the ground of an ordinary road and then immobilized therein by casting a fastening material, such as concrete, into the excavation and leaving it to set.

The enfolding region of the enfolding body 31 is fitted fast to the supporting column 28. A supporting member 34 that forms a sidewall region is formed of a resinous material, such as transparent or translucent polycarbonate plastic. A bent member 22 is joined in the neighborhood of the terminal end thereof to the supporting member 34 to form the enfolding body 31.

Numeral 32 denotes a vertically elongated nipping (holding) member formed of steel plate. The adjacent supporting members 34 are concatenated longitudinally by having the opposed terminal parts thereof fastened to each other with bolts and nuts, and held in a state nipped between the nipping members 32.

The enfolding sound barrier in the present example, therefore, has no need for the sidewall 13 during the course of installation thereof and can be easily fixed on a pedestrian road or a driveway in an ordinary road, for example.

Numeral 29 denotes a sound-absorbing part which is furnished with a sound-absorbing material 27. This sound-absorbing part 29 is fixed with reinforcing plates 33 in such a manner so as to be inclined by an angle of about 45°. The enfolding body 31 in the present example is formed in the same construction and of the same material as in the preceding example.

Here, the results of a test for noise abatement performed on the enfolding sound barrier of the present example in comparison with the conventional sound barrier will be shown. In an echoless room having glass wool applied in a thickness of 200 mm to the walls thereof, the same sound barrier as formed in the present example, a direct sound barrier formed in a height of about 2500 mm by using polyurethane foam of a thickness of about 100 mm as a sound-absorbing member and applying this sound-absorbing member to a plywood of a thickness of about 12 mm as a wall material, and a noise reducer type sound barrier of the same height were tested to determine the effect of abating noise.

For the soundproofing body, glass wool having a thickness of 50 mm was used as a sound-absorbing material. For the sidewall, polyurethane foam having a thickness of about 100 mm was used as a sound-absorbing material with a view to performing the test under the same conditions as the direct sound barrier.

A speaker as the source of sound was installed at a position separated from the surface of the floor by about 500 mm in an omnidirectional state of facing downward. From this speaker, the white noise of a noise generator amplified with an amplifier was generated. A microphone for concentrating the noise was installed at a distance of 500 mm in the horizontal direction from the speaker. The effect of sound reduction was determined under identical conditions by using this microphone to monitor the sound pressure level in the proximity of the source of sound and effecting constant formation of a fixed sound field.

A microphone for determining the soundproofing effect of a given test piece was installed at a horizontal distance of 2500 mm from the upper end of the test piece in the direction opposite to the source of sound. The sound that had passed the test piece was concentrated with this microphone, and the sound pressure level reached after the reduction of sound attained by the test piece was analyzed for frequency with a frequency analyzer. The analysis of frequency was carried out at a 1/1 octave and at a frequency in the range of 63 Hz to 4 kHz for a period of one minute. The determination analysis of this frequency was simultaneously performed on the sound from the microphone on the sound source side and the sound from the microphone on the side past the test piece.

The data of the determinations performed on the test pieces are listed and the effects of sound reduction consequently obtained are shown in Table 1, and particularly the effects of noise reduction are excerpted in Table 2. The effects of noise reductions obtained with the sound barriers of an equal height of 2.0 mH are compared in Table 3. The designation "enfolding type" used in these tables refers to the sound barrier embodying the present example. In the rows with the designation of "Effect" in Table 1, the effects of sound reduction obtained by the enfolding body 1 embodying the present example and the test piece of the noise reducer type sound barrier which was a conventional sound barrier, based on the test piece of the direct sound barrier, are described.

TABLE 1

List of data of determinations performed on given test pieces and effects of sound reduction

| Frequency (Hz) | | 63 | 125 | 250 | 500 | 1 k | 2 k | 4 k |
|---|---|---|---|---|---|---|---|---|
| | | Sound barrier 2.0 mH | | | | | | |
| Direct wall 2.0 mH | Found | 54.2 | 59.4 | 54.5 | 68.7 | 70.1 | 75.1 | 73.1 |
| Enfolding Type | Found | 53.2 | 57.7 | 53.4 | 62.6 | 65.5 | 72.4 | 68.8 |
| | Effect | 1.0 | 1.6 | 1.1 | 6.7 | 4.4 | 2.8 | 4.4 |
| Conventional type | Found | 53.3 | 58.5 | 53.2 | 68.7 | 69.5 | 74.8 | 72.0 |
| | Effect | 0.9 | 0.9 | 1.3 | 0 | 0.6 | 0.3 | 1.1 |
| | | Sound barrier 2.5 mH | | | | | | |
| Direct wall 2.0 mH | Found | 55.0 | 57.3 | 53.2 | 64.6 | 67.0 | 75.3 | 68.6 |
| Enfolding Type | Found | 53.1 | 56.3 | 52.1 | 57.1 | 60.7 | 71.0 | 67.6 |
| | Effect | 1.9 | 1.0 | 1.1 | 7.5 | 6.3 | 4.3 | 2.0 |
| Conventional type | Found | 53.9 | 56.9 | 53.0 | 62.2 | 65.2 | 74.3 | 68.3 |
| | Effect | 1.1 | 0.4 | 0.2 | 2.4 | 1.8 | 1.0 | 1.3 |

TABLE 2

Effects of noise reduction

| Frequency (Hz) | | 63 | 125 | 250 | 500 | 1 k | 2 k | 4 k |
|---|---|---|---|---|---|---|---|---|
| 2.0 mH | Enfolding type | 1.0 | 1.6 | 1.1 | 6.7 | 4.4 | 2.8 | 4.4 |
| | Conventional type | 0.9 | 0.9 | 1.3 | 0 | 0.6 | 0.3 | 1.1 |
| 2.5 mH | Enfolding type | 1.9 | 1.0 | 1.1 | 7.5 | 6.3 | 4.3 | 2.0 |
| | Conventional type | 1.1 | 0.4 | 0.2 | 2.4 | 1.8 | 1.0 | 1.3 |

TABLE 3

Effects of noise reduction by sound barrier of a height of 2.5 mH

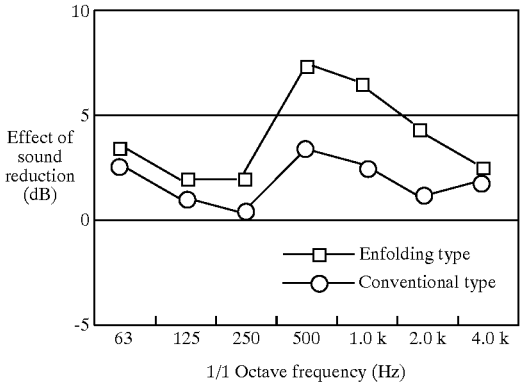

Comparison of the effects of noise reduction manifested by the test pieces involved reveals that the sound barrier of the present example was effective in reducing sound in the entire frequency zone as compared with the direct sound barrier, especially effective markedly in the frequency zone of 500 Hz to 2 kHz. The effect of sound reduction was 6 to 7 dB in the frequency zones of 500 Hz and 1 kHz in which the noise of the stationary travel of an automobile poses a problem. The test piece of the conventional sound barrier was barely effective somewhat in sound reduction as compared with the direct sound barrier but showed only a small effect in sound reduction as compared with the enfolding sound barrier of this invention.

In all the test pieces used, that of the sound barrier of this invention could obtain the highest effect in abating sound.

Now, the operation of the present invention will be specifically described below. The enfolding body 1 of this invention is constructed in an enfolding shape with the bent member 2 and this enfolding body 1 is attached to the sidewall 13. It, therefore, can be endowed with a construction that harnesses principles, such as multiple diffraction, interference of sound waves, and containment of reflected sound in the main track. The sound is abated by means of the bent member 2 that forms an enfolding region, and the noise that escapes being abated by the enfolding region is advanced as though detoured outside the enfolding region and eventually absorbed by the sound-absorbing material 7 of the sound-absorbing part 9 disposed in an inclined state. When the sound-absorbing material 2 is additionally attached fast to the outer peripheral side of the bent member 2, the sound barrier can enhance the reduction of noise as compared with the conventional sidewall and soundproofing device and can manifest the effect of abating sound in a wider frequency zone.

Specifically, the enfolding body 1 is bent from the height of about 2 m above the surface of the ground onward into component segments of a length of about 200 cm at angles of about 173°, about 142°, about 142°, about 1420 and about 142°, finished in a height of about 500 mm and an inside diameter of about 600 mm, provided on the upper part of the leading terminal thereof with the sound-absorbing material 7, and further provided on the rear surface thereof with the sound-absorbing part 9 inclined at an angle of about 45°. Thus, this enfolding body 1, in spite of the smallness of its size, can acquire the maximum interference and manifest the effect of abating noise to an enhanced degree.

By causing the enfolding body 1 to assume such a special shape as is furnished on the ceiling terminal side of the sound barrier with the sound-absorbing part 9, it is able to manifest a particularly good effect of abating sound at a place encountering a serious noise problem. Even when the direct sound barrier requires a height of installation exceeding 8 m for the purpose of acquiring an effect of abating sound, for example, it can derive the effect of abating sound from this special shape. When the noise is still larger, a plurality of bent members 2 can be piled up. Thus, the enfolding sound barrier can be installed in the optimum state that suits the site of installation.

Further, since the component members of the soundproofing region can be easily formed and worked, the soundproofing region can be constructed at a low cost. Since these components have low weights, they can be fitted by a simple process.

Since the enfolding region can be displaced in the direction of increasing width relative to the road, for example, it is capable of diminishing the protrusion thereof toward the passageway of vehicles or a railroad and incapable of interfering with the passage of vehicles and a railroad car. It, therefore, can save space for its installation.

When the supporting member 34 of the enfolding body 31 constructed as illustrated in FIG. 6 is formed of a transparent or translucent polycarbonate plastic or other similar resinous material and used on an ordinary road, it can contribute to the preservation of safety and secure a generous field of vision because the condition of the road and the scene of the environment can be visually discerned through the enfolding body 31.

INDUSTRIAL APPLICABILITY

As is clear from the foregoing description, this invention can provide a sound barrier which manifests a high effect in abating noise in a wide frequency zone as compared with the conventional direct sound barrier and the noise reducer type sound barrier, secures a generous view of the environment as well and further promises a cut in the cost of construction.

Further, the enfolding sound barrier of this invention excels in durability, workability in the field of installation and practicability.

What is claimed is:

1. An enfolding sound barrier comprising:

a sidewall; and an enfolding body attached to said sidewall, said enfolding body having an enfolding shape and including a bent member comprising four bent parts each being bent at an angle of 142°.

2. The enfolding sound barrier of claim 1, wherein said sidewall comprises a transparent sidewall.

3. The enfolding sound barrier of claim 2, wherein said enfolding body further includes a back surface having a sound-absorbing part at an upper part of said back surface and extending in an inclined manner with respect to a horizontal plane.

4. The enfolding sound barrier of claim 2, wherein said bent member includes a sound-absorbing material fixed onto an outer peripheral surface side of a leading terminal region of said bent member.

5. The enfolding sound barrier of claim 2, further comprising a supporting member integrally fixed to said bent member to form a further enfolding shape, said supporting member having a bent part bent at an angle of 173°.

6. The enfolding sound barrier of claim 2, further comprising at least two bent members, each of said bent members comprising four bent parts each being bent at an angle of 142°, said bent members being piled in at least two stages, one on top of the other.

7. The enfolding sound barrier of claim 2, further comprising a supporting member integrally fixed to said bent member to form a further enfolding shape, and a leading terminal member, wherein said bent member, said supporting member, and said leading terminal member are each made of an aluminum alloy and formed in a plate shape by a process including extrusion molding.

8. The enfolding sound barrier of claim 2, wherein said enfolding member has an enfolding region displaced in a width direction of an adjacent transportation route.

9. The enfolding sound barrier of claim 2, wherein said transparent sidewall is formed of a resinous material of polycarbonate plastic.

10. The enfolding sound barrier of claim 1, wherein said enfolding body further includes a back surface having a sound-absorbing part at an upper part of said back surface and extending in an inclined manner with respect to a horizontal plane.

11. The enfolding sound barrier of claim 1, wherein said bent member includes a sound-absorbing material fixed onto an outer peripheral surface side of a leading terminal region of said bent member.

12. The enfolding sound barrier of claim 1, further comprising a supporting member integrally fixed to said bent member to form a further enfolding shape, said supporting member having a bent part bent at an angle of 173°.

13. The enfolding sound barrier of claim 1, further comprising at least two bent members, each of said bent members comprising four bent parts each being bent at an angle of 142°, said bent members being piled in at least two stages, one on top of the other.

14. The enfolding sound barrier of claim 1, further comprising a supporting member integrally fixed to said bent member to form a further enfolding shape, and a leading terminal member, wherein said bent member, said supporting member, and said leading terminal member are each made of an aluminum alloy and formed in a plate shape by a process including extrusion molding.

15. The enfolding sound barrier of claim 1, wherein said enfolding member has an enfolding region displaced in a width direction of an adjacent transportation route.

16. The enfolding sound barrier of claim 1, wherein said sidewall comprises a transparent sidewall formed of a resinous material of polycarbonate plastic.

17. The enfolding sound barrier of claim 1, wherein said enfolding sound barrier is applied to one of a road, an express highway, and a railroad.

* * * * *